US009533198B2

(12) United States Patent
Yamamoto

(10) Patent No.: US 9,533,198 B2
(45) Date of Patent: Jan. 3, 2017

(54) RACKET FRAME

(71) Applicant: Dunlop Sports Co. Ltd., Kobe-shi, Hyogo (JP)

(72) Inventor: Yosuke Yamamoto, Kobe (JP)

(73) Assignee: DUNLOP SPORTS CO. LTD., Kobe-Shi (JP)

( * ) Notice: Subject to any disclaimer, the term of this patent is extended or adjusted under 35 U.S.C. 154(b) by 0 days.

(21) Appl. No.: 14/181,259

(22) Filed: Feb. 14, 2014

(65) Prior Publication Data

US 2014/0296005 A1 Oct. 2, 2014

(30) Foreign Application Priority Data

Mar. 28, 2013 (JP) ..... 2013-070276

(51) Int. Cl.
*A63B 49/04* (2006.01)

(52) U.S. Cl.
CPC ..... *A63B 49/04* (2013.01); *A63B 60/02* (2015.10); *A63B 60/42* (2015.10); *A63B 49/022* (2015.10); *A63B 2209/08* (2013.01)

(58) Field of Classification Search
CPC ... A63B 49/04; A63B 53/145; A63B 59/0096; A63B 59/06; A63B 49/00; A63B 59/0014; A63B 59/0033; A63B 59/0092; A63B 15/00; A63B 49/08; A63B 2053/0491; A63B 49/06; A63B 53/00; A63B 53/16
USPC ..... 473/332, 519, 522, 535, 540
See application file for complete search history.

(56) References Cited

U.S. PATENT DOCUMENTS

| | | | | |
|---|---|---|---|---|
| 4,693,474 A * | 9/1987 | Glaessgen | ..... | A63B 60/02 473/519 |
| 5,039,097 A * | 8/1991 | Bartlett | ..... | A63B 60/02 473/519 |
| 5,651,545 A * | 7/1997 | Nashif | ..... | A63B 60/54 473/520 |
| 5,762,570 A * | 6/1998 | Shaw | ..... | A63B 60/54 473/522 |
| 6,071,203 A * | 6/2000 | Janes | ..... | A63B 49/02 473/535 |
| 6,527,656 B1 * | 3/2003 | Cheng | ..... | A63B 60/54 473/539 |

(Continued)

FOREIGN PATENT DOCUMENTS

| | | |
|---|---|---|
| DE | 35 27 823 A1 | 5/1986 |
| JP | 2003-175133 A | 6/2003 |

(Continued)

*Primary Examiner* — Gene Kim
*Assistant Examiner* — Christopher Glenn
(74) *Attorney, Agent, or Firm* — Birch, Stewart, Kolasch & Birch, LLP

(57) ABSTRACT

In a racket frame 2, stoppers 28 are each located on a tip side of a narrow diameter portion 26 protruding from a side of an inner circumferential surface 4*b* of a head 4. A steel sheets 16 is fixed on the side of the inner circumferential surface 4*b* opposing the stoppers 28 via the narrow diameter portion 26. Weights 14 each include a magnet sheet 32. The narrow diameter portion 26 is inserted through notches 36 and 38 of the weights 14. The steel sheets 16 and the magnet sheet 32 are bound with magnetic force. The notches 36 and 38 of the weights 14 are locked to a string protecting member 12. The stoppers 28 prevent the weights 14 from being detached form the head 4. The weights 14 are detachably mounted on the head 4.

11 Claims, 12 Drawing Sheets

(56) References Cited

U.S. PATENT DOCUMENTS

| | | | | |
|---|---|---|---|---|
| 7,691,016 | B2 * | 4/2010 | Ashino | A63B 49/022 473/521 |
| 2009/0215558 | A1 * | 8/2009 | Bothwell | A63B 51/00 473/540 |
| 2013/0196785 | A1 * | 8/2013 | Takechi | A63B 53/04 473/332 |
| 2013/0316858 | A1 * | 11/2013 | Yu | A63B 60/42 473/519 |

FOREIGN PATENT DOCUMENTS

| | | | |
|---|---|---|---|
| JP | 2004-052939 | A | 2/2004 |
| JP | 3746268 | B2 | 2/2006 |
| JP | 2006-110093 | A | 4/2006 |
| JP | 4363006 | B2 | 11/2009 |

* cited by examiner

RACKET FRAME

This application claims priority on Patent Application No. 2013-070276 filed in JAPAN on Mar. 28, 2013. The entire contents of this Japanese Patent Application are hereby incorporated by reference.

BACKGROUND OF THE INVENTION

Field of the Invention

The present invention relates to racket frames used in tennis. In more detail, the present invention relates to racket frames having a function for adjusting weight balance.

Description of the Related Art

Weight balance of a racket frame greatly affects characteristics of a tennis racket such as inertia moment etc. The weight balance affects basic performances such as flight, ease of swinging, and sensation of hitting etc. The weight balance is often changed in accordance with aptitude and preference of a player. Changing of the weight balance is performed by attaching a weight to the racket frame for adjustment.

For example, a weight is affixed to a racket frame. In order to additionally change the weight balance in the racket frame having the weight affixed thereto, it is necessary to replace the weight etc. Thus, time and effort are needed for adjusting the weight balance of the racket.

JP No. 3746268 discloses a dynamic damper in which vertical frame parts and horizontal frame parts are integrally molded into a grid pattern. The dynamic damper is affixed to a frame. In the dynamic damper, a string is threaded through openings formed on the grid pattern. In order to replace the dynamic damper, it is necessary to restring the string.

JP No. 4363006 discloses a dynamic damper detachably attached to a desired position on a racket frame. In the dynamic damper, a belt is attached to the frame. In this attachment structure, the belt enables the dynamic damper to be detachable. This dynamic damper can be replaced without restringing the string.

It is conceivable to attach a weight using the attachment structure of JP No. 4363006. With this attachment structure, replacing or reaffixing the weight can be performed easily compared to a structure of affixing the weight. By adopting this attachment structure, the weight balance can be adjusted easily.

In the attachment structure, the belt is also wound on an outer circumferential surface of the racket frame. The belt may make contact with the ground or a structure. With such contact, the position of the weight may shift or the weight may become separated from the racket frame. Such attachment structure may change the weight balance of the racket frame.

An objective of the present invention is to provide a racket frame that enables adjusting of weight balance easily with certainty.

SUMMARY OF THE INVENTION

A racket frame according to the present invention includes a head, a string protecting member, a weight, and a frame magnetic body. The string protecting member includes a grommet through which a string is inserted, a narrow diameter portion located on a tip side of the grommet, and a stopper located at a tip of the narrow diameter portion. The grommet penetrates through an outer circumferential surface and an inner circumferential surface of the head. The stopper is located on a side of the tip of the narrow diameter portion protruding from a side of the inner circumferential surface of the head. The frame magnetic body is fixed on the side of the head's inner circumferential surface opposing the stopper via the narrow diameter portion. The weight includes a weight magnetic body. The weight magnetic body and the frame magnetic body tug each other with magnetic force. The weight has a notch. The notch has inserted therethrough the narrow diameter portion. The notch of the weight is locked to the narrow diameter portion. The stopper prevents detachment of the weight in a direction from the outer circumferential surface to the inner circumferential surface of the head. The weight is detachably mounted on the head.

Preferably, at the inner circumferential surface of the head, a concaved portion is formed where the weight is mounted. Preferably, the weight magnetic body is a magnet sheet. Preferably, the weight includes a resin cover. The magnet sheet and the resin cover are stacked. Preferably, the resin cover is thicker at a peripheral part of the notch of the weight than other parts.

Preferably, a chamfer is formed on an outer circumference of the stopper on a tip side thereof.

Preferably, a chamfer is formed on an outer circumference of the stopper on a side of the inner circumferential surface of the head.

Preferably, the notch of the weight is formed at both ends of the weight in a longitudinal direction thereof, and at least one part between the both ends. The notches formed at the both ends in the longitudinal direction each have an opening facing outward in the longitudinal direction. The notch formed between the both ends has an opening facing a direction orthogonal to the longitudinal direction.

Preferably, the string protecting member of the racket frame includes the narrow diameter portion. The stopper is fixed to the tip of the narrow diameter portion. An insertion hole penetrating the narrow diameter portion and the stopper is formed. The grommet protruding from the side of the inner circumferential surface of the head is inserted through the insertion hole. The narrow diameter portion is fixed to the head.

Preferably, the string protecting member includes a stationary plate. The string protecting member includes at least two of the narrow diameter portion. Bases of the narrow diameter portions are fixed to the stationary plate. The stationary plate is fixed to the head.

Preferably, the string protecting member of the racket frame includes an insertion part and a locking claw. The stopper is fixed to a tip of the insertion part. The locking claw is fixed to a base of the insertion part. A hole penetrating the insertion part and the stopper is formed. The insertion part is inserted through the hole of the grommet through which the string is threaded. The stopper is positioned so as to protrude from a tip of the grommet. The locking claw is locked such that the insertion part is prevented from being detached from the grommet. The narrow diameter portion is formed from the grommet protruding from the inner circumferential surface of the head.

DESCRIPTION OF THE PREFERRED EMBODIMENTS

The following will describe in detail the present invention based on preferred embodiments with reference to the accompanying drawing.

Figure 1:
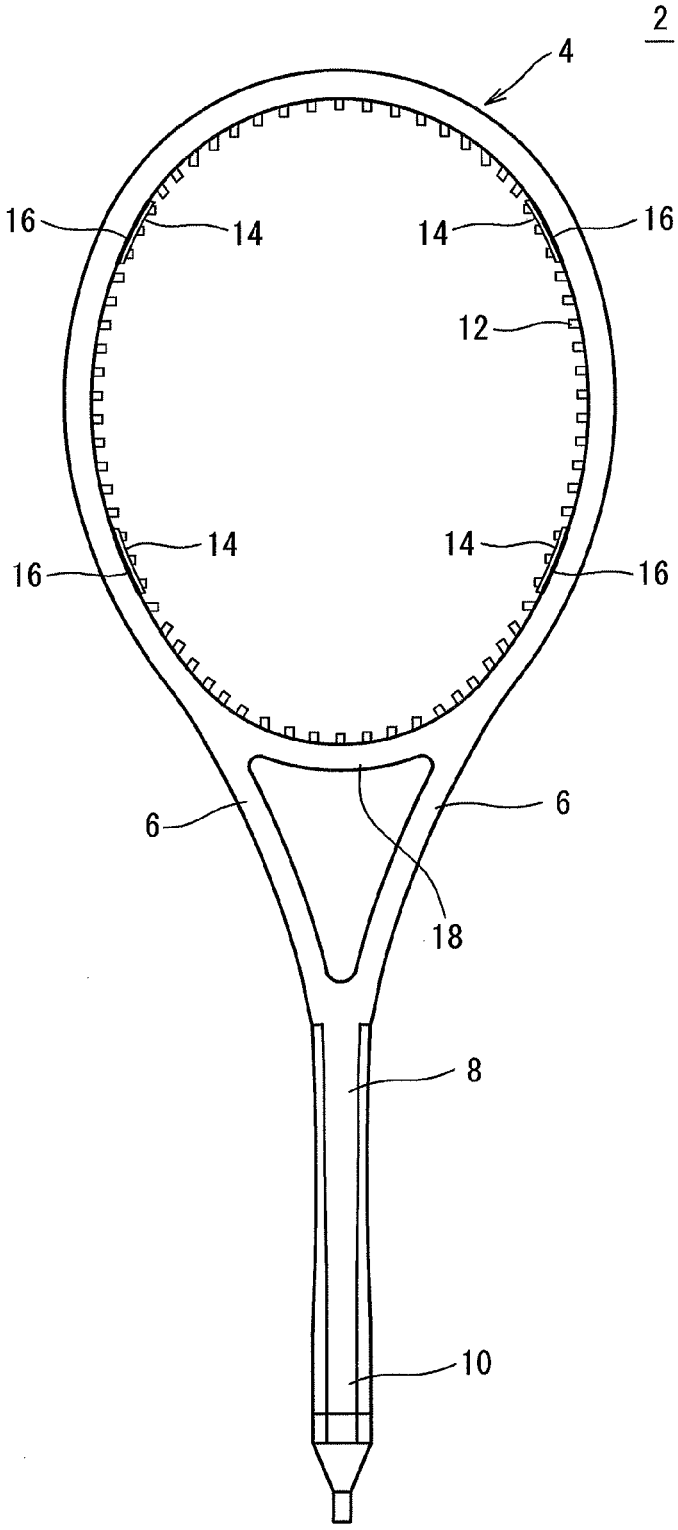
FIG. 1 is a front view showing a racket frame according to one embodiment of the present invention.
Figure 2:
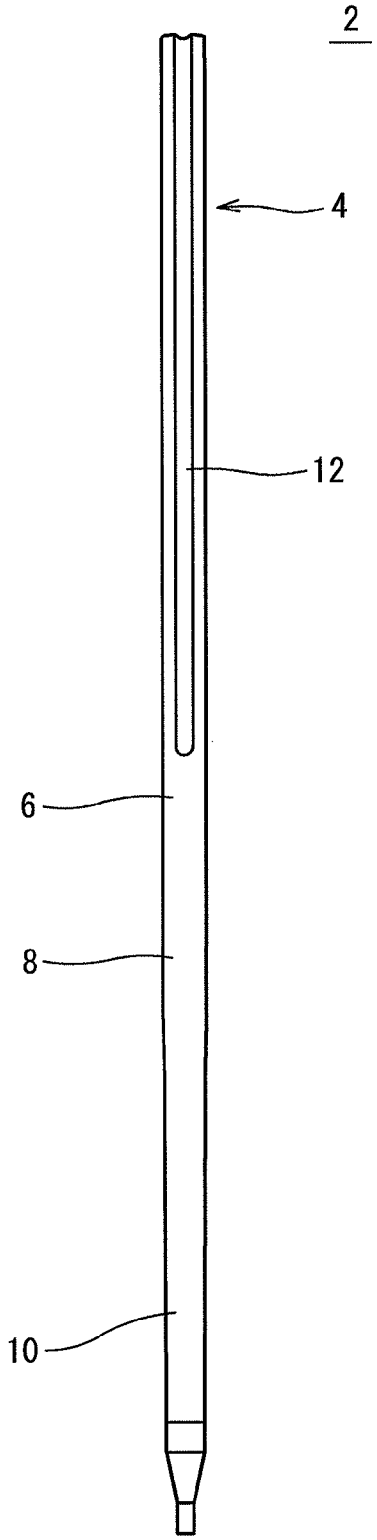
FIG. 2 is a lateral view showing the racket frame in FIG. 1.

A racket frame 2 shown in FIGS. 1 and 2 includes a head 4, one pair of throats 6, a shaft 8, a grip 10, a string protecting member 12, weights 14, and steel sheets 16 as frame magnetic bodies. Although not shown, a grip tape, an end cap, and the like are attached to the racket frame 2, and a string is strung to obtain a racket for tennis. In FIG. 1, the up-down direction is an axial direction of the racket frame 2, and the right-left direction is a width direction of the racket frame 2.

The main parts (the head 4, the pair of throats 6, the shaft 8, and the grip 10) of the racket frame 2 are formed from a fiber reinforced resin. A matrix resin of the fiber reinforced resin is a thermosetting resin. A representative thermosetting resin is epoxy resin. A representative fiber of the fiber reinforced resin is carbon fiber. This fiber is a continuous fiber. The racket frame 2 is hollow. The main parts of the racket frame 2 are molded by winding a plurality of layers of a prepreg, and curing a thermosetting resin contained in the prepreg.

The head 4 forms the outline of a hitting surface. The front shape of the head 4 is approximately elliptical. The major-axis direction of the ellipse matches the axial direction of the racket frame 2. The minor-axis direction of the ellipse matches the width direction of the racket frame 2. One end of each of the throats 6 is continuously connected to the head 4. In the vicinity of the other end, one of the throats 6 meets the other throat 6. The throats 6 extend from the head 4 to the shaft 8. The shaft 8 extends from the point where the two throats 6 meet. The shaft 8 is continuously and integrally formed with the throats 6. The grip 10 is continuously and integrally formed with the shaft 8. A portion of the head 4 interposed between the two throats 6 is a yoke 18.

Figure 3:
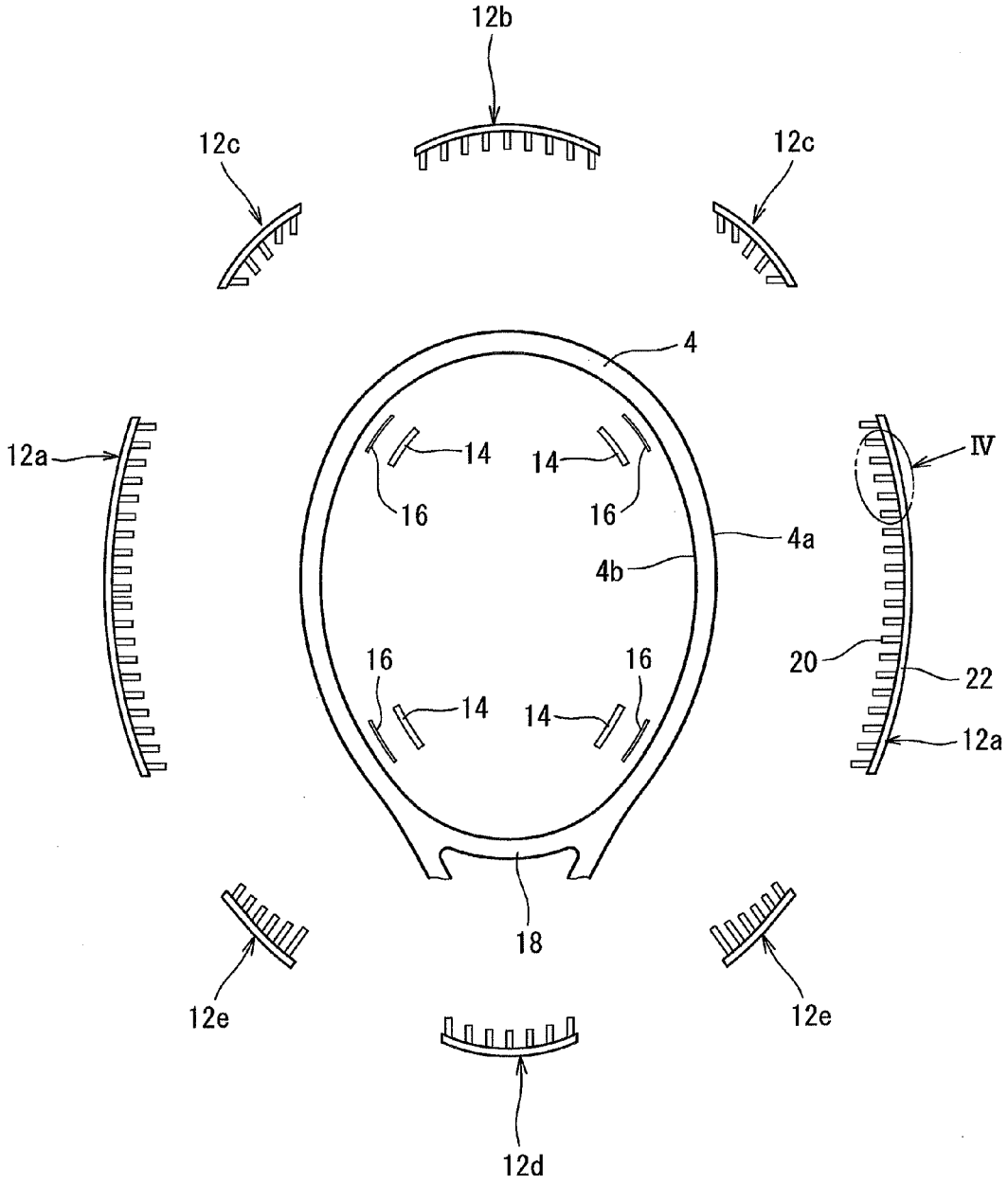
FIG. 3 is an exploded front view showing one part of the racket frame in FIG. 1.

As shown in FIG. 3, in the racket frame 2, the string protecting member 12 includes one pair of string protecting members 12*a* disposed on an outer circumferential surface 4*a* in the width direction of the head 4, a string protecting member 12*b* disposed on the outer circumferential surface 4*a* at the tip of the head 4 in the axial direction, one pair of string protecting members 12*c* disposed on the outer circumferential surface 4*a* between the string protecting member 12*b* and the string protecting members 12*a*, a string protecting member 12*d* disposed on the outer circumferential surface 4*a* of the yoke 18, and one pair string protecting members 12*e* disposed on the outer circumferential surface 4*a* between the string protecting member 12*d* and the string protecting members 12*a*.

Each of the string protecting members 12*a* includes a plurality of grommets 20, and a support 22 that links the grommets 20. The string protecting members 12*b* to 12*e* each also include a plurality of grommets 20 and a support 22 that links the grommets 20.

Figure 4:
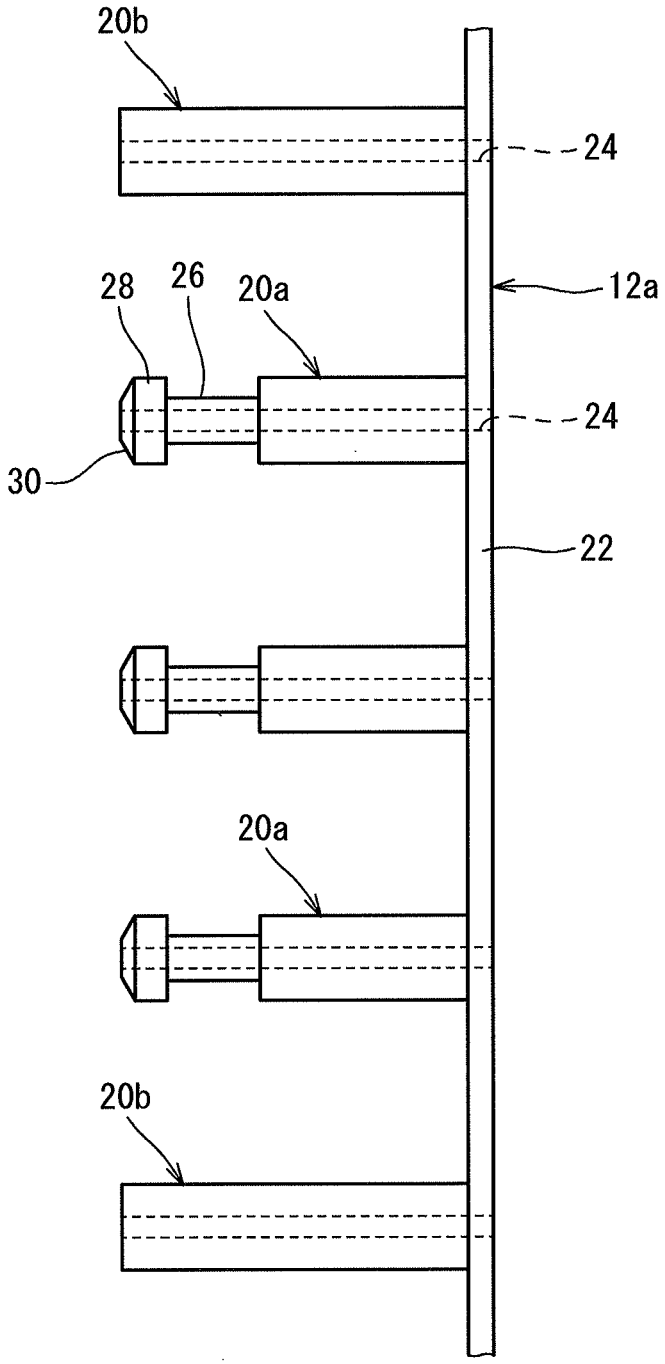
FIG. 4 is an enlarged illustrative diagram of a part indicated by arrow IV in FIG. 3.

As shown in FIG. 4, each of the string protecting members 12*a* includes a plurality of grommets 20*a*, and a plurality of grommets 20*b*. On each of the string protecting members 12*a*, string holes 24 penetrating the grommets 20 (20*a* and 20*b*) and the support 22 are formed. In each of the string protecting members 12*a*, three of the grommets 20*a* are arranged in the circumferential direction on the tip side of the head 4 in the axial direction. The grommets 20*b* are arranged in the circumferential direction on both sides of the three grommets 20*a*. Although not shown, in each of the string protecting members 12*a*, three of the grommets 20*a* are arranged in the circumferential direction also on the grip 10 side in the axial direction in a manner similar to the tip side of the head 4 in the axial direction. The grommets 20*b* are also arranged in the circumferential direction also on both sides of these three grommets 20*a*.

The grommets 20*b* have a cylindrical shape. The diameter of the outer circumferential surface of each of the grommets 20*b* is constant from the tip to the base that reaches the support 22.

The grommets 20*a* have a cylindrical shape. A narrow diameter portion 26 is fixed to the tip of each of the grommets 20*a*. A stopper 28 is fixed to the tip of the narrow diameter portion 26. The outer diameter of the narrow diameter portion 26 is set to be smaller than the outer diameter of each of the grommets 20*a*. The outer diameter of the stopper 28 is identical to the outer diameter of each of the grommets 20*a*. The stopper 28 protrudes from the outer circumferential surface of the narrow diameter portion 26 outward in the radial direction of each of the grommets 20*a*. A chamfer 30 is formed on the outer circumference of the stopper 28 at a tip side thereof.

In the string protecting members 12*a*, although three of the grommets 20*a*, the narrow diameter portions 26, and the stoppers 28 are arranged in the circumferential direction between the grommets 20*b*, four or more of the grommets 20*a*, the narrow diameter portions 26, and the stoppers 28 may be arranged, or all of the grommets 20*b* may be changed into the grommets 20*a*, the narrow diameter portions 26, and the stoppers 28. Similarly to the string protecting members 12*a*, it is also possible to form the grommets 20*a*, the narrow diameter portions 26, and the stoppers 28 in the string protecting members 12*b* to 12*e*.

Figure 5A:
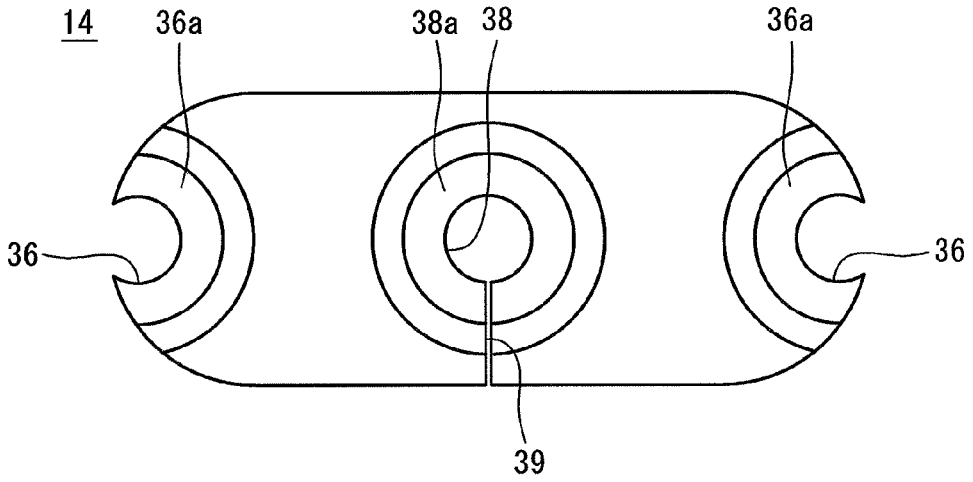
FIG. 5A is a front view of a weight of the racket frame in FIG. 1.
Figure 5B:
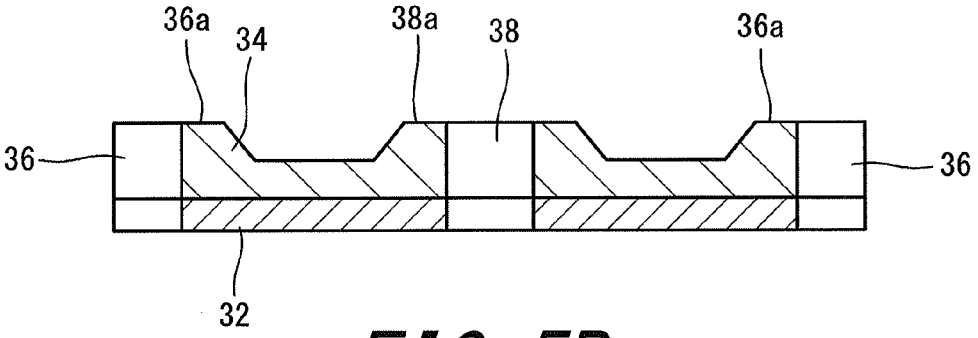
FIG. 5B is a cross sectional view of the weight.

As shown in FIGS. 5A and 5B, each of the weights 14 includes a magnet sheet 32 as a weight magnetic body, and a resin cover 34. The magnet sheet 32 is a flexible sheet-like magnet. The resin cover 34 is stacked on the magnet sheet 32 and integrally formed therewith. The resin cover 34 is also flexible.

Notches 36 and 38 are formed in each of the weights 14. The notches 36 are formed at both ends in the longitudinal direction such that openings of the notches 36 face outward in the longitudinal direction. The shapes of the notches 36 and 38 are formed into shapes configured to lock onto the outer circumferential surfaces of the narrow diameter portions 26. In the present example, the shapes of the notches 36 and 38 are formed into shapes that follow the outer circumferential surfaces of the narrow diameter portions 26. The notch 38 is formed between the pair of notches 36. A cut 39 is formed from the notch 38 toward a direction orthogonal to the longitudinal direction, and the notch 38 has an opening facing a direction orthogonal to the longitudinal direction. The notch 38 is also notched in a shape configured to lock onto the outer circumferential surface of the narrow diameter portion 26. The resin cover 34 is formed so as to be thicker at peripheral parts 36*a* of the notches 36 and a peripheral part 38*a* of the notch 38 than other portions.

Figure 6:
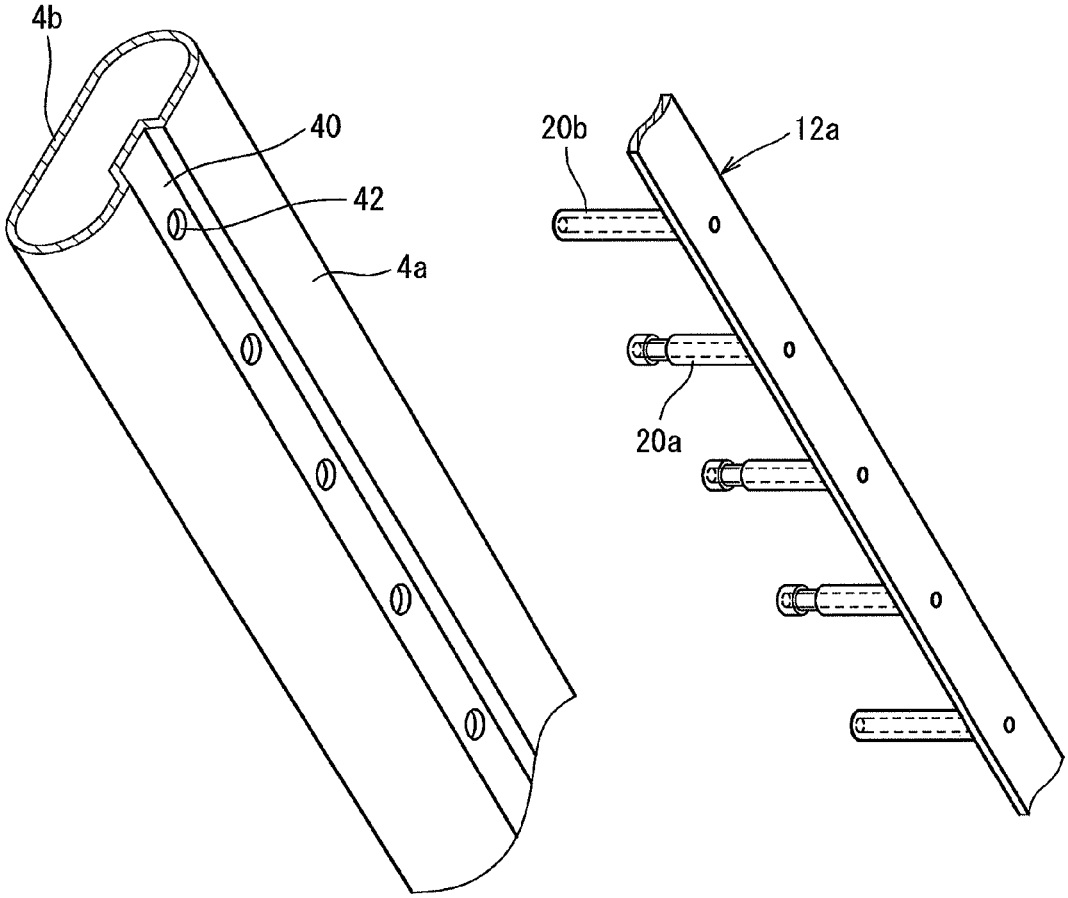
FIG. 6 is an illustrative diagram showing one part of a head and one part of a string protecting member in FIG. 1.

As shown in FIG. 6, a groove 40 extending in the circumferential direction is formed on the outer circumferential surface 4*a* of the head 4. In the groove 40, a plurality of grommet holes 42 penetrating the outer circumferential surface 4*a* to an inner circumferential surface 4*b* are formed. The plurality of grommet holes 42 are formed in the groove 40 so as to be spaced in the circumferential direction.

The grommets 20*a* and 20*b* of the string protecting members 12*a* are inserted through the grommet holes 42. The support 22 is fitted into the groove 40. The string protecting members 12*a* are attached to the head 4 in this manner. Similarly to the string protecting members 12*a*, the string protecting members 12*b* to 12*e* are also attached to the head 4.

Figure 7:
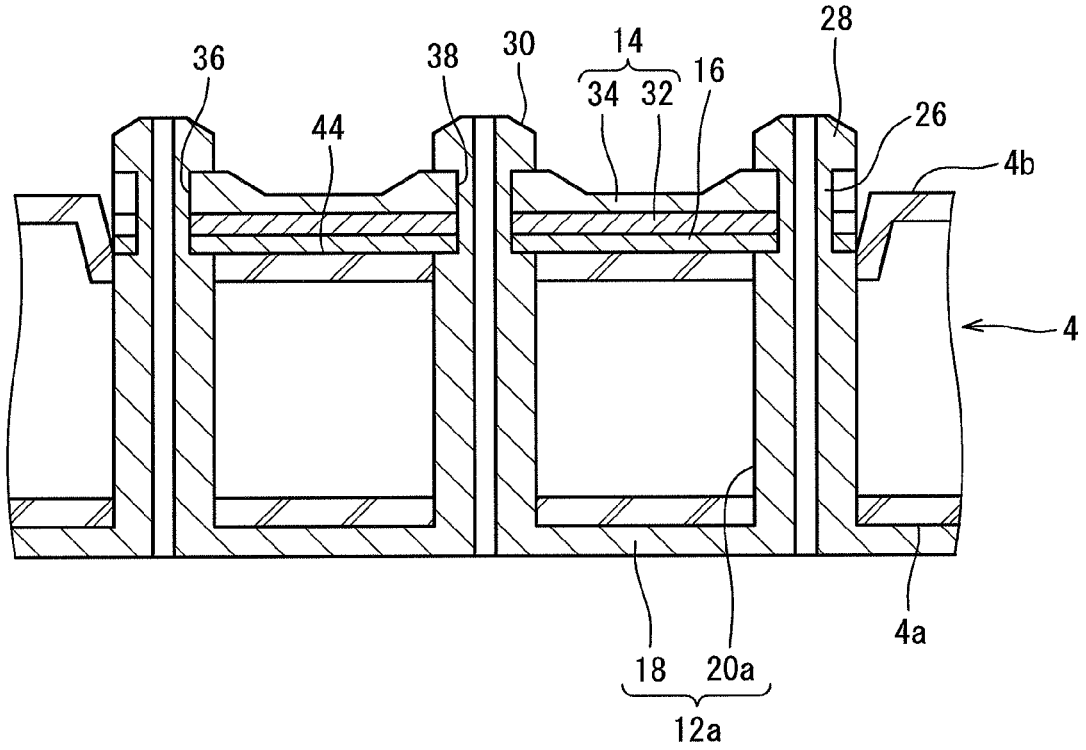
FIG. 7 is another illustrative diagram showing one part of the head and one part of the string protecting member in FIG. 1.

FIG. 7 shows a cross section of a state in which the string protecting members 12*a* and the weights 14 are attached to the head 4. A concaved portion 44 is formed on the inner circumferential surface 4*b* of the head 4. The area size of the bottom surface of the concaved portion 44 is set to be equal to or larger than a range where each of the weights 14 is to be mounted. Each of the steel sheets 16 is fixed to the concaved portion 44 (the inner circumferential surface 4*b*). In other words, each of the steel sheets 16 is fixed on the side of the inner circumferential surface 4*b* opposing the stoppers 28 via the narrow diameter portion 26. Each of the steel sheets 16 is formed from a steel plate having a small thickness. The area size of each of the steel sheets 16 is set to be equal to or larger than a range where each of the weights 14 is to be mounted.

The narrow diameter portions 26 and the stoppers 28 located at the tip of each of the grommets 20*a* protrude from the concaved portion 44 (the inner circumferential surface 4*b*) of the head 4.

The weights 14 are bound to the respective steel sheets 16 with magnetic force. The narrow diameter portion 26 is inserted through the notches 36 and the notch 38 of each of the weights 14. The notches 36 and the notch 38 are locked onto the narrow diameter portions 26. The peripheral parts 36*a* of the notches 36 and the peripheral part 38*a* of the notch 38 are pinched between the stoppers 28 and each of the steel sheets 16. The stoppers 28 prevent detachment of the weights 14.

Figure 8:
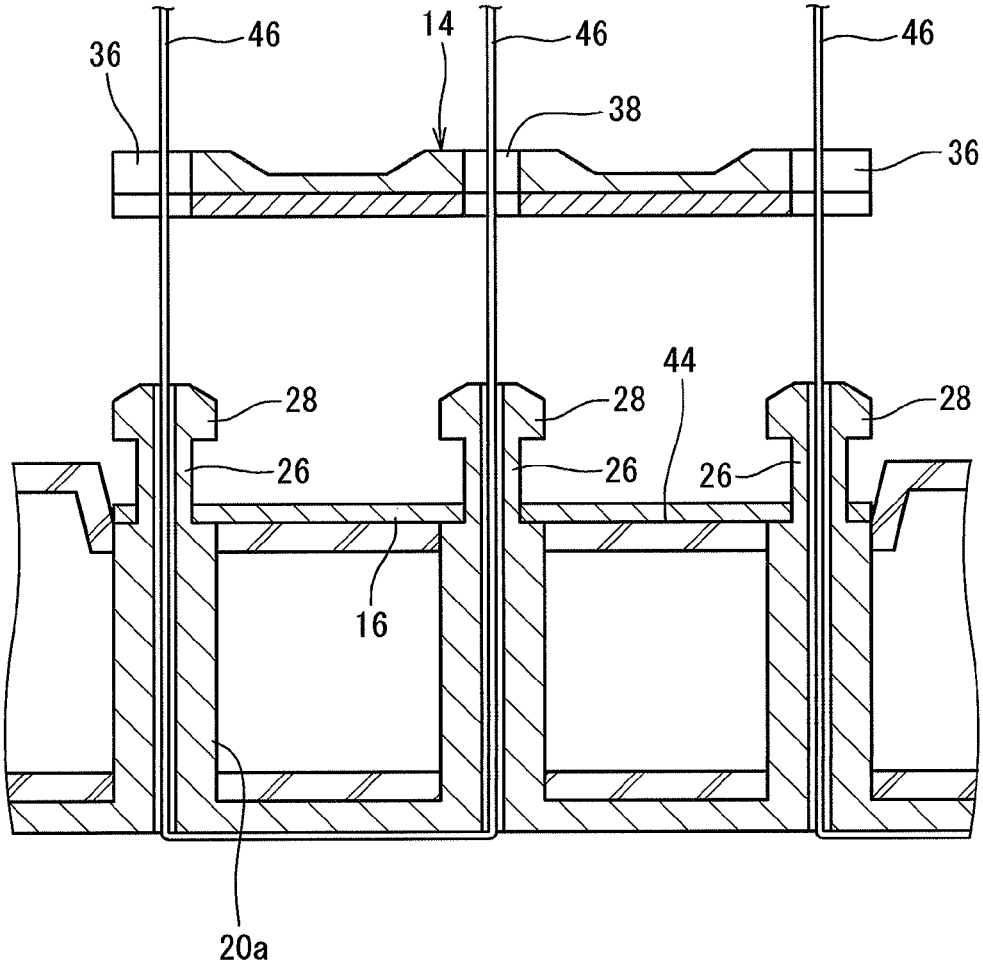
FIG. 8 is still another illustrative diagram showing one part of the head and one part of the string protecting member in FIG. 1.

A method for mounting the weights 14 will be described with reference to FIG. 8. A string 46 threaded through the grommets 20*a* is passed through the notches 36 and 38 of each of the weights 14. In addition, each of the weights 14 is pressed against the stoppers 28. Each of the weights 14 is deformed to enable the stoppers 28 to be inserted through the notches 36 and 38. The weights 14 are attached firmly to the steel sheets 16 with magnetic force. In this manner, the mounted state shown in FIG. 7 is obtained.

A method for detaching the weights 14 will be described. From the state in FIG. 7, each of the weights 14 is deformed, and the notches 36 and 38 are separated from the stoppers 28. The notches 36 and 38 are removed from the stoppers 28. Each of the weights 14 is detached from the stoppers 28 along the string 46. The string 46 is removed from the notches 36 and 38. In this manner, the weights 14 are taken off. Then, another weight may be attached.

In the racket frame 2, since the notches 36 and 38 are included, the weights 14 can be attached and detached while the string 46 is strung. Since the stoppers 28 are inserted through the notches 36 and 38, the weights 14 can be easily attached and detached.

In the mounted state shown in FIG. 7, since the weights 14 and the respective steel sheets 16 are attached firmly to each other with magnetic force, gaps are prevented from occurring between the weights 14 and the steel sheets 16.

In the racket frame 2, the steel sheets 16 are fixed to the head 4. Even when the steel sheets 16 are formed to be extremely thin, sufficient magnetic force can be generated between the steel sheets 16 and magnets. The steel sheets 16 contribute in preventing increase of weight of the racket frame 2.

As long as the weights 14 and the head 4 are attached firmly to each other with magnetic force, the head 4 may be fixed to the magnet sheet and a steel sheet may be used for the weights 14, or a magnet may be used for either one of the weights 14 or the head 4 and a magnetic body that is attracted to the magnet on the other side may be used.

In addition, the narrow diameter portions 26 are locked to the notches 36 and the notch 38 of each of the weights 14. The weights 14 are prevented from being detached by the stoppers 28. With this, each of the weights 14 is fixed to a predetermined position, and shifting of the position is suppressed. Shifting of the position of each of the weights 14 is suppressed even when the racket frame 2 receives a strong impact.

Since the weights 14 are mounted on the concaved portion 44 of the inner circumferential surface 4*b* of the head 4, the weights 14 are prevented from protruding toward the hitting surface. With the racket frame 2, even when a ball is hit near the head 4 away from the sweet spot on the hitting surface, interference between the ball and the weights 14 is prevented. The ball is prevented from being hit in an unexpected direction. Shifting of the position of each of the weights 14 when the ball is hit is suppressed.

Since each of the weights 14 is formed from the magnet sheet 32 and the resin cover 34, the resin cover 34 provides reinforcement to the magnet sheet 32. By having the resin cover 34, damage to the magnet sheet 32 is prevented.

The resin cover 34 is reinforced through thickening of the peripheral parts 36*a* of the notches 36 and the peripheral part 38*a* of the notch 38. As a result, damage to the weights 14 is prevented. Furthermore, the weights 14 are easily deformed since the other parts are formed thin. With this, the weights 14 are easily attached and detached.

Since the chamfer 30 is formed on each of the stoppers 28, the weights 14 can be mounted more easily. Furthermore, a chamfer may be formed also on the concaved portion 44 side of each of the stoppers 28. In other words, a chamfer may be formed on the outer circumference of each of the stoppers 28 on a side of the inner circumferential surface 4*b* of the head 4. The chamfer on the concaved portion 44 side enables the weights 14 to be removed easily. The chamfer 30 is not limited to a C-chamfer that is diagrammatically represented, and may be, for example, an R-chamfer.

On each of the weights 14, the notches 36, which are located at both ends in the circumferential direction of the head 4, have openings facing outward in the circumferential direction. Since the notches 36 are located at both ends of each of the weights 14 in the circumferential direction, both ends of each of the weights 14 are pinched by the stoppers 28 and each of the steel sheets 16. Furthermore, since the notch 38 located between the both ends has an opening facing a direction orthogonal to the circumferential direction, shifting of the head 4 is suppressed in all directions of the plane including the circumferential direction and a direction orthogonal to the circumferential direction.

The string protecting member 12, the weights 14, and the steel sheets 16 of the racket frame 2 can be later-attached to a conventional racket frame. Adjusting the weight balance can be performed easily by mounting the string protecting member 12, the weights 14, and the steel sheets 16 to a conventional racket frame.

Although the weights 14 are attached to the string protecting members 12*a* in the racket frame 2, the weights 14 may be attached to the string protecting members 12*b* to 12*e*. In the racket frame 2, although the weights 14 can be attached/detached to/from four parts which are the pair of parts at the tip side and the pair of parts at the grip side, the present disclosure is not limited thereto. The attachment position of the weights 14 may be one part, two parts, three parts, or five parts of the racket frame 2.

Figure 9:
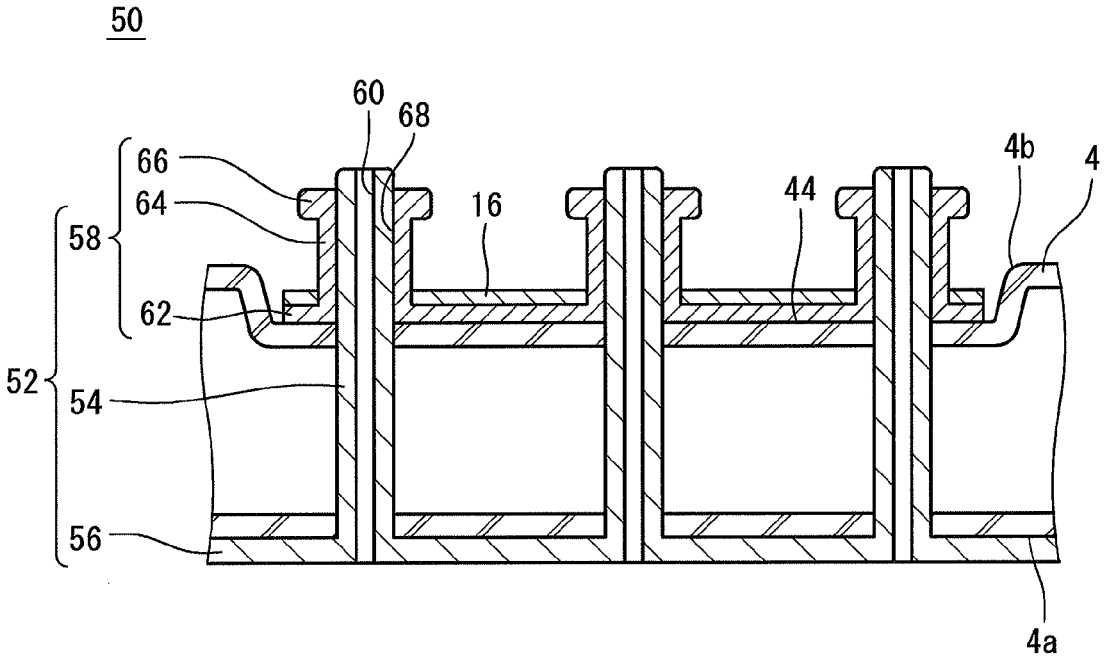
FIG. 9 is an illustrative diagram showing one part of a head and one part of a string protecting member of a racket frame according to another embodiment of the present invention.

FIG. 9 shows a cross section of one part of a string protecting member 52 of a racket frame 50 according to another embodiment of the present invention. The racket frame 50 has the same configuration as the racket frame 2 except the string protecting member 52 is used instead of the string protecting member 12 of the racket frame 2. Here, description will be provided for components that are different from the racket frame 2, and description of similar components will be omitted. In addition, similar components will be described using the same reference characters.

The string protecting member 52 includes grommets 54, a support 56, and a mount part 58. On the string protecting member 52, string holes 60 penetrating the grommets 54 and the support 56 are formed. The grommets 54 each have a cylindrical shape.

Figure 10:
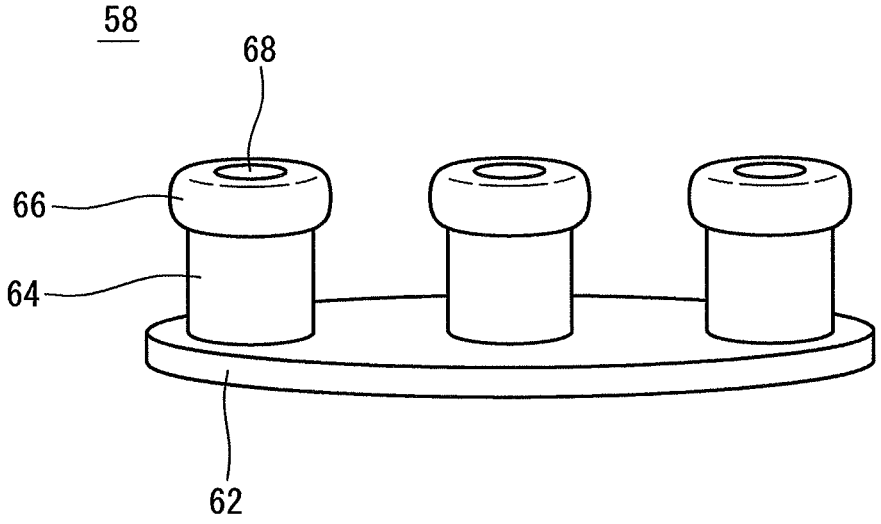
FIG. 10 is an illustrative diagram of a mount part of the string protecting member in FIG. 9.

As shown in FIG. 10, the mount part 58 of the string protecting member 52 includes a stationary plate 62, and a plurality of narrow diameter portions 64 and a plurality of stoppers 66. Each of the narrow diameter portions 64 is formed in a cylindrical shape. The tips of the narrow diameter portions 64 are fixed to the stoppers 66. Bases of the narrow diameter portions 64 are fixed to the stationary plate 62. Insertion holes 68 penetrating the stationary plate 62, and the narrow diameter portions 64 and the stoppers 66 are formed. In FIGS. 9 and 10, although three of the narrow diameter portions 64 and three of the stoppers 66 are fixed on the stationary plate 62 in the longitudinal direction, the number of those may be four, five, or more.

As shown in FIG. 9, the mount part 58 is fixed on the inner circumferential surface 4*b* by having the stationary plate 62 positioned between the steel sheets 16 and the inner circumferential surface 4*b*. The steel sheets 16 is fixed on the side of the inner circumferential surface 4*b* opposing the stoppers 66 via the narrow diameter portions 64. The grommets 54 are inserted through the insertion holes 68. In the racket frame 50, the narrow diameter portions 64 are inserted through the notches 36 and 38 of the weights 14. Each of the weights 14 is bound to each of the steel sheets 16 with magnetic force and, as a result, bound to the stationary plate 62. The weights 14 are prevented from being detached by the stoppers 66.

For the racket frame 50, a string protecting member for a conventional racket frame can be applied as is. Weight balance can easily be adjusted by using the weights 14, the steel sheets 16, and the mount part 58 on a conventional racket frame.

Figure 11:
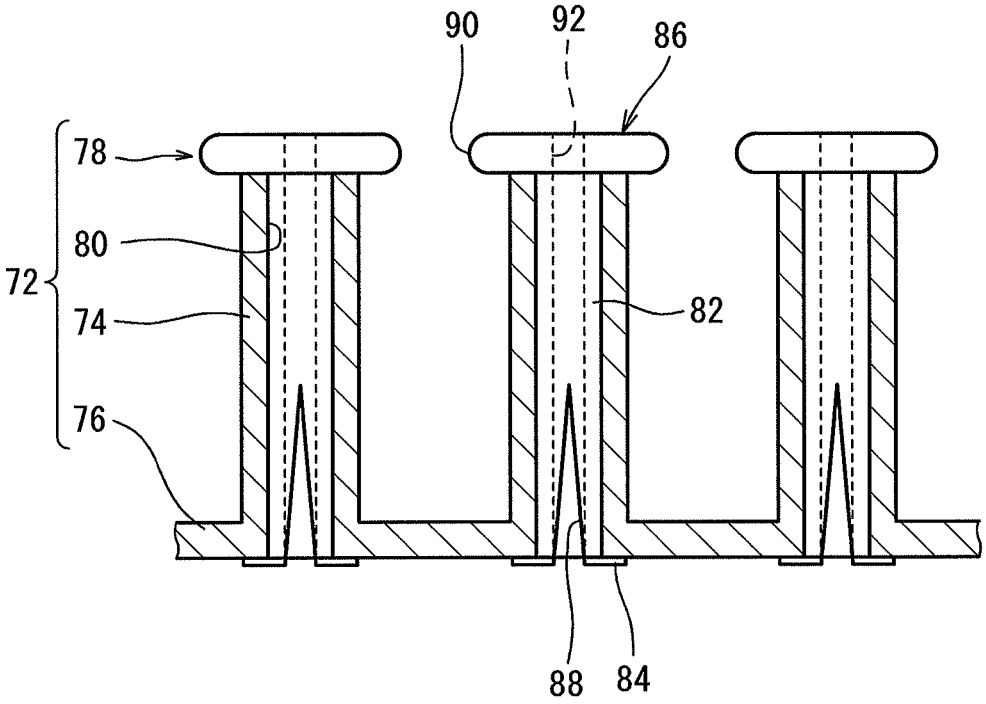
FIG. 11 is an illustrative diagram showing one part of a string protecting member of a racket frame according to still another embodiment of the present invention.

FIG. 11 shows a cross section of one part of a string protecting member 72 of a racket frame according to still another embodiment of the present invention. The racket frame has the same configuration as the racket frame 2 except the string protecting member 72 is used instead of the string protecting member 12 of the racket frame 2. Here, description will be provided for components that are different from the racket frame 2, and description of similar components will be omitted. In addition, similar components will be described using the same reference characters.

The string protecting member 72 includes grommets 74, a support 76 and a mount part 78. On the string protecting member 72, string holes 80 penetrating the grommets 74 and the support 76 are formed. The grommets 74 each have a cylindrical shape.

Figure 12:
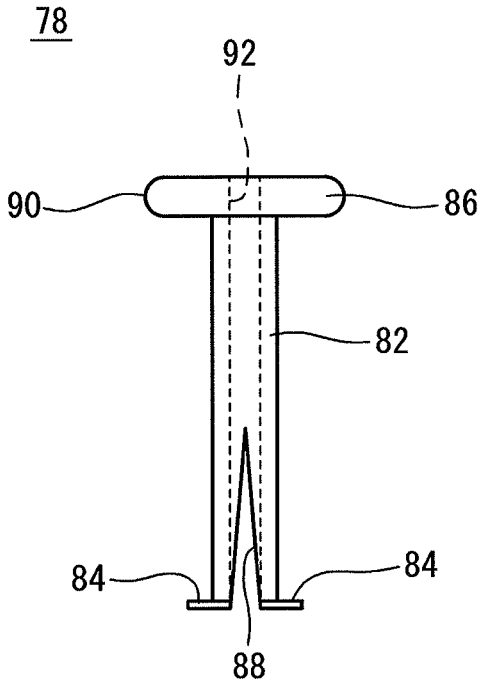
FIG. 12 is an illustrative diagram of a mount part of the string protecting member in FIG. 11.

As shown in FIG. 12, the mount part 78 includes insertion parts 82, lock parts 84 as locking claws, and stoppers 86. The stoppers 86 are fixed to the tips of the insertion parts 82. The lock parts 84 are fixed to bases of the insertion parts 82. Each of the insertion parts 82 is formed in a cylindrical shape, and has a notch 88 formed on the base side. Because of the notch 88, diameters of the insertion parts 82 on the base side can be reduced in the radial direction of the insertion parts 82.

The lock parts 84 protrude outward in the radial direction of the insertion parts 82. The stoppers 86 protrude outward in the radial direction of the insertion parts 82. As shown in FIG. 12, tips 90 of the stoppers 86 are formed in an R-shape and protrude in the radial direction of the insertion parts 82. Penetration holes 92 penetrating the insertion parts 82 and the stoppers 86 are formed.

As shown in FIG. 11, the insertion parts 82 of the mount part 78 are inserted through the string holes 80. The stoppers 86 protrude from the tips of the grommets 74. The stoppers 86 protrude from the outer circumferential surface of the grommets 74 outward in the radial direction. The lock parts 84 are locked onto the support 76. With this, the mount part 78 is prevented from being detached from the grommets 74.

In the mount part 78, the insertion parts 82 are reduced in diameter at the base side in the radial direction, and the insertion parts 82 are inserted through the string holes 80 from the tips of the grommets 74. The lock parts 84 at the bases of the insertion parts 82 inserted through the string holes 80 are locked to the support 76. In this manner, the mount part 78 can be attached/detached to/from the grommets 74.

In the racket frame using the string protecting member 72, the outer circumferential surfaces of the grommets 74 pass through the notches 36 and 38 of the weights 14 and are locked. The notches 36 and 38 are locked at the tip portions of the grommets 74 protruding from the inner circumferential surface 4*b* of the head 4. In the string protecting member 72, the tip portions of the grommets 74 protruding from the inner circumferential surface 4*b* of the head 4 function as the narrow diameter portion. The stoppers 86 prevent detachment of the weights 14. In the racket frame, a string is threaded through the penetration holes 92 to be strung.

For the racket frame, a string protecting member for a conventional racket frame can be applied as is. Weight balance can easily be adjusted by using the weights 14, the steel sheets 16, and the mount part 78 on a conventional racket frame.

EXAMPLES

The following will show the effects of the present invention by means of Examples, but the present invention should not be construed in a limited manner based on the description of these Examples.

Example 1

The racket frame shown in FIGS. 1 to 7 was manufactured. The racket frame was obtained based on "NEOMAX3000" manufactured by Dunlop Sports Co., Ltd. The racket frame was prepared without having a weight mounted thereto.

Examples 2 to 9

Four weights of 1.5 g and four weights of 3 g were prepared. These weights were attached to two parts on the tip side and two parts on the grip side of the head shown in FIG. 3. The weight of the weights and the mounted position thereof are shown in Table 1. Other than that, rackets were prepared in a manner similar to Example 1.

[Measurement of Weight and Swing Weight]

The weight and swing weight of the racket frames of the Examples were measured. The swing weight was measured using RDC manufactured by Babolat. The results are shown in Table 1.

TABLE 1

| Measurement Result | | | | | | |
|---|---|---|---|---|---|---|
| | | Example 1 | Example 2 | Example 3 | Example 4 | Example 5 |
| Weight (g) | Head tip side × two parts | 0 | 0 | 1.5 | 1.5 | 0 |
| | Head grip side × two parts | 0 | 1.5 | 0 | 1.5 | 3.0 |
| Weight (g) | | 285 | 288 | 288 | 291 | 291 |
| Swing weight (kg · cm$^2$) | | 280 | 281 | 283 | 284 | 283 |

| | | Example 6 | Example 7 | Example 8 | Example 9 |
|---|---|---|---|---|---|
| Weight (g) | Head tip side × two parts | 3.0 | 1.5 | 3.0 | 3.0 |
| | Head grip side × two parts | 0 | 3.0 | 1.5 | 3.0 |
| Weight (g) | | 291 | 294 | 294 | 297 |
| Swing weight (kg · cm$^2$) | | 289 | 286 | 290 | 292 |

As shown in Table 1, by shifting the weights, the weight and swing weight were adjusted. In other words, with the racket frames, weight balance can be adjusted easily with certainty. From this evaluation result, it is clear that the present invention is advantageous.

The above description is merely for illustrative examples, and various modifications can be made without departing from the principles of the present invention.

What is claimed is:

1. A racket frame comprising:

a head;

a string protecting member;

a weight; and a frame magnetic body, wherein the string protecting member includes a grommet through which a string is inserted, a narrow diameter portion located on a tip side of the grommet, and a stopper located at a tip of the narrow diameter portion, the grommet penetrates through an outer circumferential surface and an inner circumferential surface of the head, the stopper is located on a side of the tip of the narrow diameter portion protruding from a side of the inner circumferential surface of the head, the frame magnetic body is fixed on the side of the head's inner circumferential surface opposing the stopper via the narrow diameter portion, the weight includes a weight magnetic body, the weight magnetic body and the frame magnetic body tug each other with magnetic force, the weight has a notch, the notch has inserted therethrough the narrow diameter portion, the notch of the weight is locked to the narrow diameter portion, the grommet penetrates through the notch of the weight, the notch has an opening configured to extend from one surface of the weight to another surface of the weight along an axial direction of the grommet, the stopper prevents detachment of the weight in a direction from the outer circumferential surface to the inner circumferential surface of the head, the weight is configured to be detachably mounted on the head after the racket is strung, the weight is pinched between the stopper and the frame magnetic body, and the weight and the frame magnetic body are attached firmly to each other with magnetic force to prevent gaps from occurring between the weight and the frame magnetic body.

2. The racket frame according to claim 1, wherein at the inner circumferential surface of the head, a concaved portion is formed where the weight is mounted.

3. The racket frame according to claim 1, wherein the weight magnetic body is a magnet sheet.

4. The racket frame according to claim 3, wherein the weight includes a resin cover, and the magnet sheet and the resin cover are stacked.

5. The racket frame according to claim 4, wherein the resin cover is thicker at a peripheral part of the notch of the weight than other parts.

6. The racket frame according to claim 1, wherein a chamfer is formed on an outer circumference of the stopper on a tip side thereof.

7. The racket frame according to claim 1, wherein a chamfer is formed on an outer circumference of the stopper on a side of the inner circumferential surface of the head.

8. The racket frame according to claim 1, wherein the notch of the weight is formed at both ends of the weight in a longitudinal direction thereof, and at least one part between the both ends, the notches formed at the both ends in the longitudinal direction each have an opening facing outward in the longitudinal direction, and the notch formed between the both ends has an opening facing a direction orthogonal to the longitudinal direction.

9. The racket frame according to claim 1, wherein the string protecting member includes the narrow diameter portion, the stopper is fixed to a tip of the narrow diameter portion, an insertion hole penetrating the narrow diameter portion and the stopper is formed, the grommet protruding from the side of the inner circumferential surface of the head is inserted through the insertion hole, and the narrow diameter portion is fixed to the head.

10. The racket frame according to claim 9, wherein the string protecting member includes a stationary plate and at least two of the narrow diameter portion, bases of the narrow diameter portions are fixed to the stationary plate, and the stationary plate is fixed to the head.

11. The racket frame according to claim 1, wherein the string protecting member includes an insertion part and a locking claw, the stopper is fixed to a tip of the insertion part, the locking claw is fixed to a base of the insertion part, a hole penetrating the insertion part and the stopper is formed, the insertion part is inserted through the hole of the grommet through which the string is threaded, the stopper is positioned so as to protrude from a tip of the grommet, the locking claw is locked such that the insertion part is prevented from being detached from the grommet, and the narrow diameter portion is formed from the grommet protruding from the inner circumferential surface of the head.

* * * * *